US006927559B2

(12) United States Patent
Tanigawa et al.

(10) Patent No.: US 6,927,559 B2
(45) Date of Patent: Aug. 9, 2005

(54) CONSTANT VOLTAGE POWER SUPPLY

(75) Inventors: Hiroshi Tanigawa, Tsurugashima (JP); Satoru Yamane, Tsurugashima (JP)

(73) Assignee: Toko, Inc., Tokyo (JP)

( * ) Notice: Subject to any disclaimer, the term of this patent is extended or adjusted under 35 U.S.C. 154(b) by 101 days.

(21) Appl. No.: 10/723,780

(22) Filed: Nov. 24, 2003

(65) Prior Publication Data

US 2004/0104712 A1 Jun. 3, 2004

(30) Foreign Application Priority Data

Nov. 25, 2002 (JP) ..... 2002-340607

(51) Int. Cl.[7] ..... G05F 3/16
(52) U.S. Cl. ..... 323/316; 323/315
(58) Field of Search ..... 323/312, 315, 323/316

(56) References Cited

U.S. PATENT DOCUMENTS

| | | | | |
|---|---|---|---|---|
| 5,404,096 A | | 4/1995 | Thiel | |
| 5,596,265 A | * | 1/1997 | Wrathall et al. | 323/315 |
| 6,034,518 A | * | 3/2000 | Yuasa | 323/316 |
| 6,066,944 A | * | 5/2000 | Sakurai | 323/315 |
| 6,369,554 B1 | | 4/2002 | Aram | |
| 6,559,626 B2 | * | 5/2003 | Horie | 323/282 |

FOREIGN PATENT DOCUMENTS

| | | |
|---|---|---|
| JP | 62-210724 | 9/1987 |
| JP | 09-107253 | 4/1997 |
| JP | 2000-013161 | 1/2000 |
| JP | 2001-117650 | 4/2001 |
| JP | 2001-222331 | 8/2001 |

* cited by examiner

*Primary Examiner*—Adolf Berhane
(74) *Attorney, Agent, or Firm*—Cohen, Pontani, Lieberman & Pavane

(57) ABSTRACT

Disclosed is a constant voltage power supply, which comprises an error amplifier VEA including a transistor M3, and a transistor M4 having the same ratio between channel width and channel length as that of the transistor M3. The gate and source of the transistor M4 are connected to the gate of a transistor M3 to form a current mirror circuit in conjunction with the transistor M3. Further, the drain of the transistor M4 is connected with a transistor M5 adapted to be switched in response to an external control signal Sg. For example, when the transistor M5 is in ON state, any signal amplification function of the transistor M3 is vanished away, and the gain of the error amplifier VEA is lowered. The circuit configuration for changing the gain of the error amplifier VEA makes it possible to strike a balance between high-speed response characteristic in an active mode and operational stability in a sleep mode, and reduce a circuit area required for being formed on an integrated circuit.

5 Claims, 4 Drawing Sheets

CONSTANT VOLTAGE POWER SUPPLY

FIELD OF THE INVENTION

The present invention relates to a constant voltage power supply, and more particularly to a technology for changing the gain of an error amplifier of a constant voltage power supply depending on whether a load is in a sleep mode or in an active mode.

DESCRIPTION OF THE PRIOR ART

Generally, recent electronic apparatuses have a function in which upon fulfilling predetermined conditions, a part (e.g. display unit) of the apparatus is switched from a regular operation mode (hereinafter referred to as "active mode") to a power-saving operation mode (hereinafter referred to as "sleep mode").

A typical electronic apparatus includes a load consuming electric power, and a constant voltage power supply for supplying electric power to the load. In order to stabilize an output voltage with a high degree of accuracy when a load is in the active mode, the constant voltage power supply is required to have a high responsiveness to variation in the load (hereinafter referred to as "high-speed response characteristic"). However, the high-speed response characteristic of the constant voltage power supply will be useless after the load goes into the sleep mode, because almost no variation in the load occurs in the sleep mode.

From this point of view, a constant voltage power supply having the following features has been developed.

i) The constant voltage power supply includes a first error amplifier adapted to provide a relatively higher high-speed response characteristic and relatively increased power consumption, and a second error amplifier adapted to provide a relatively lower high-speed response characteristic and relatively reduced power consumption.

ii) The first and second error amplifiers are selectively used depending on whether a load is in the sleep mode or in the active mode, in a switchable manner.

This technology is disclosed in Japanese Patent Laid-Open Publication No. 2001-117650.

FIG. 1 is a circuit diagram of a constant voltage power supply selectively using either one of two error amplifiers in a switchable manner, based on the technology disclosed in the Japanese Patent Laid-Open Publication No. 2001-117650.

In FIG. 1, EA1 indicates a first error amplifier which is a high-speed response/high power-consumption type amplifier. EA2 indicates a second error amplifier which is a low-speed response/low power-consumption type amplifier. The first error amplifier EA1 has an output terminal connected to the gate of a series control power transistor PTr through a switch SW1, and the second error amplifier EA2 has an output terminal connected to the gate of the power transistor PTr through a switch SW2. The P-channel type power transistor PTr has a source connected to a power supply line (Vcc) with low voltage stability through an input terminal 1 of the constant voltage power supply, and a drain connected to a load 5 through an output terminal 2 of the constant voltage power supply.

A resistor R11, a resistor R12 and a transistor Q1 are connected in series between the drain of the power transistor PTr and the ground (or reference voltage point of the circuit), and a node between the resistor R11 and the resistor R12 is connected to a non-inverting input terminal (+) of the first error amplifier EA1. A resistor R21, a resistor R22 and a transistor Q2 are connected in series between the drain of the power transistor PTr and the ground, and a node between the resistor R21 and the resistor R22 is connected to a non-inverting input terminal (+) of the second error amplifier EA2.

Each of the inverting input terminals (−) of the first and second error amplifiers EA1, EA2 is connected to a signal terminal 3 receiving a reference voltage signal (Vref).

Further, a switching logic circuit 6 is provided to detect the state of the load so as to selectively turn on either one of a first group consisting of the switch SW1 and the transistor Q1, and a second group consisting of the switch SW2 and the transistor Q2, depending on the detected state of the load.

According to the above constant voltage power supply, when the load is in the active mode, the first group consisting of the switch SW1 and the transistor Q1 is switched into ON state, and the second group consisting of the switch SW2 and the transistor Q2 is switched into OFF state, in accordance to a signal from the switching logic circuit 6. Then, the first error amplifier EA1 is activated, and the power transistor PTr is driven by the first error amplifier EA1. Thus, while the power consumption is relatively increased, the constant voltage power supply is operated with an enhanced high-speed response characteristic.

When the load is in the sleep mode, the first group consisting of the switch SW1 and the transistor Q1 is switched into OFF state, and the second group consisting of the switch SW2 and the transistor Q2 is switched into ON state, in accordance to a signal from the switching logic circuit 6. Then, the second error amplifier EA2 is activated, and the power transistor PTr is driven by the second error amplifier EA2. Thus, while the high-speed response characteristic is relatively lowered, the constant voltage power supply is operated with low power consumption.

As above, the constant voltage power supply in FIG. 1 is configured to obtain a reasonable high-speed response characteristic when needed and to facilitate power saving when there is no need for the high-speed response characteristic.

When a load is in the sleep mode, the rate of current flowing through a constant voltage power supply is reduced. In a constant voltage power supply arranged such that an error amplifier for driving a series control power transistor has a high gain, when the current flow rate becomes extremely small, there are risks of instability in circuit operation and occurrence of circuit oscillation. In view of these risks, the constant voltage power supply in FIG. 1 is designed such that the gain of the second error amplifier EA2 is set lower than that of the first error amplifier EA1 to strike a balance between the high-speed response characteristic in the active mode and the stability in circuit operation (hereinafter referred to as "operational stability") in the sleep mode.

The constant voltage power supply selectively using the two error amplifiers in a switchable manner is excellent in the balance between the high-speed response characteristic and the operational stability, and power saving. However, a practical design for forming such a constant voltage power supply on an integrated circuit has involved a problem of increased cost due to the requirement of a large circuit area. As for this problem, there have been proposed technologies for an error amplifier configured to change the level of internal operating current, and a constant voltage power supply incorporating the amplifier, as a second aspect of an invention disclosed in Japanese Patent Laid-Open Publication No. 2001-117650.

The error amplifier configured to change the level of operating current, as disclosed in Japanese Patent Laid-Open Publication No. 2001-117650, allows the constant voltage power supply incorporating it to provide a reduced circuit area and an enhanced power saving effect. However, it is difficult to achieve a gain control (changeover) for striking a balance between the high-speed response characteristic in the active mode and the operational stability in the sleep mode.

SUMMARY OF THE INVENTION

It is therefore an object of the present invention to provide a constant voltage power supply capable of striking a balance between the high-speed response characteristic in the active mode and the operational stability in the sleep mode.

It is another object of the present invention to provide a constant voltage power supply capable of eliminating the need for a large circuit area.

In order to achieve the above object, according to the present invention, there is provided a constant voltage power supply including a series control transistor connected between of input and output terminals of the constant voltage power supply, and an error amplifier circuit having an output terminal connected to a control terminal of the series control transistor, wherein the operation of the series control transistor is controlled in accordance with an output voltage signal supplied to one input terminal of the error amplifier circuit from the series transistor, and a reference voltage signal supplied to another input terminal of the error amplifier circuit, so as to provide an stabilized output voltage. The constant voltage power supply comprises: a first amplifier circuit including first and second transistors, wherein one ends of the respective main current paths of the first and second transistors are connected to a common node to allow the first and second transistors to be formed as a differential pair; a second amplifier circuit including a third transistor which has an control terminal adapted to be supplied with a signal appearing at the other end of the main current path of the second transistor; a fourth transistor having an control terminal and an main current path, wherein the control terminal and one end of the main current path are connected to the control terminal of the third transistor to provide a current mirror circuit in conjunction with the third transistor; and a first switch connected in series to the other end of the main current path of the fourth transistor and adapted to be switched in response to an external control signal.

The above constant voltage power supply of the present invention may be specifically configured as follows.

The error amplifier in the constant voltage power supply may comprise a differential amplifier circuit including first and second transistors whose sources are connected to a common node to form a deferential pair, an amplifier circuit including a third transistor which has a gate connected to the drain of the second transistor, a fourth transistor having a gate and a source which are connected to the gate of the third transistor so as to provide a current mirror circuit in conjunction with the third transistor, and a first switch connected to the drain of the fourth transistor and adapted to be switched in response to an external control signal.

This specific circuit is operated as follows.

When a load is in the active mode, the first switch is switched into OFF state according to the external control signal to switch the fourth transistor into its deactivated state. This precludes the third and fourth transistors from performing any current mirror operation, and allows the third transistor to fulfill a signal amplification function. Thus, the gain of the error amplifier is increased to provide enhanced high-speed response characteristic.

When the load is in the sleep mode, the first switch is switched into ON state according to the external control signal to switch the fourth transistor into its activated state. This allows the third and fourth transistors to perform a current mirror operation so as to vanish any signal amplification function from the third transistor. Thus, the gain of the error amplifier is lowered to provide enhanced operational stability in a low current flow rate.

DESCRIPTION OF THE PREFERRED EMBODIMENT

Figure 1:
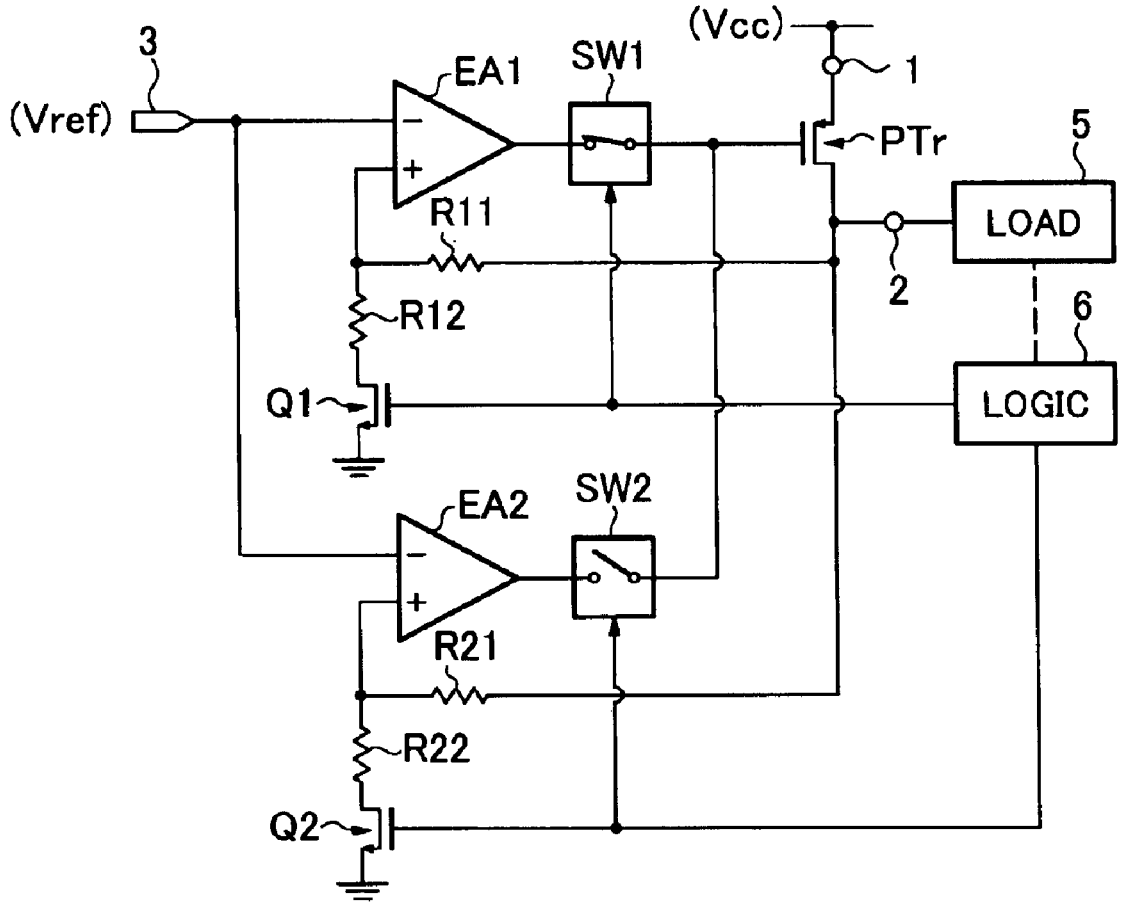
FIG.1 (PRIOR ART)
FIG. 1 is a block diagram of a conventional constant voltage power supply configured to selectively use two error amplifiers different in characteristic, in a switchable manner.
Figure 2:
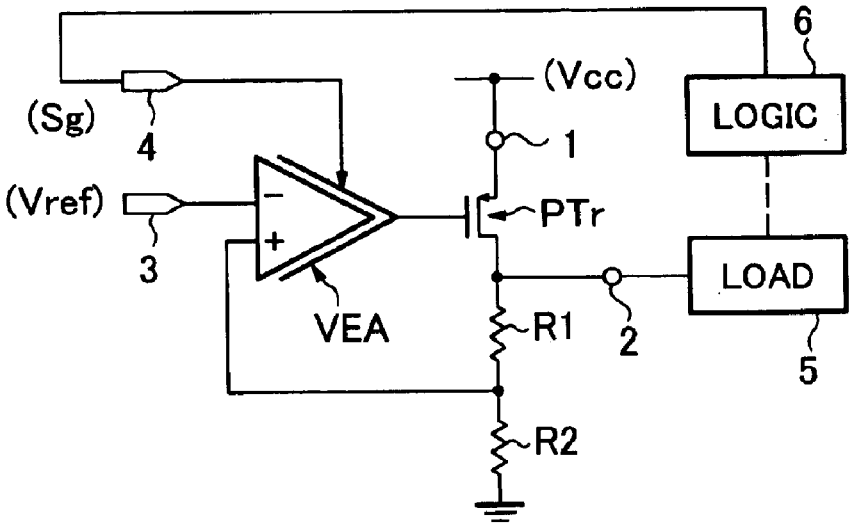
FIG. 2 is a block diagram of a constant voltage power supply according to one embodiment of the present invention.
Figure 3:
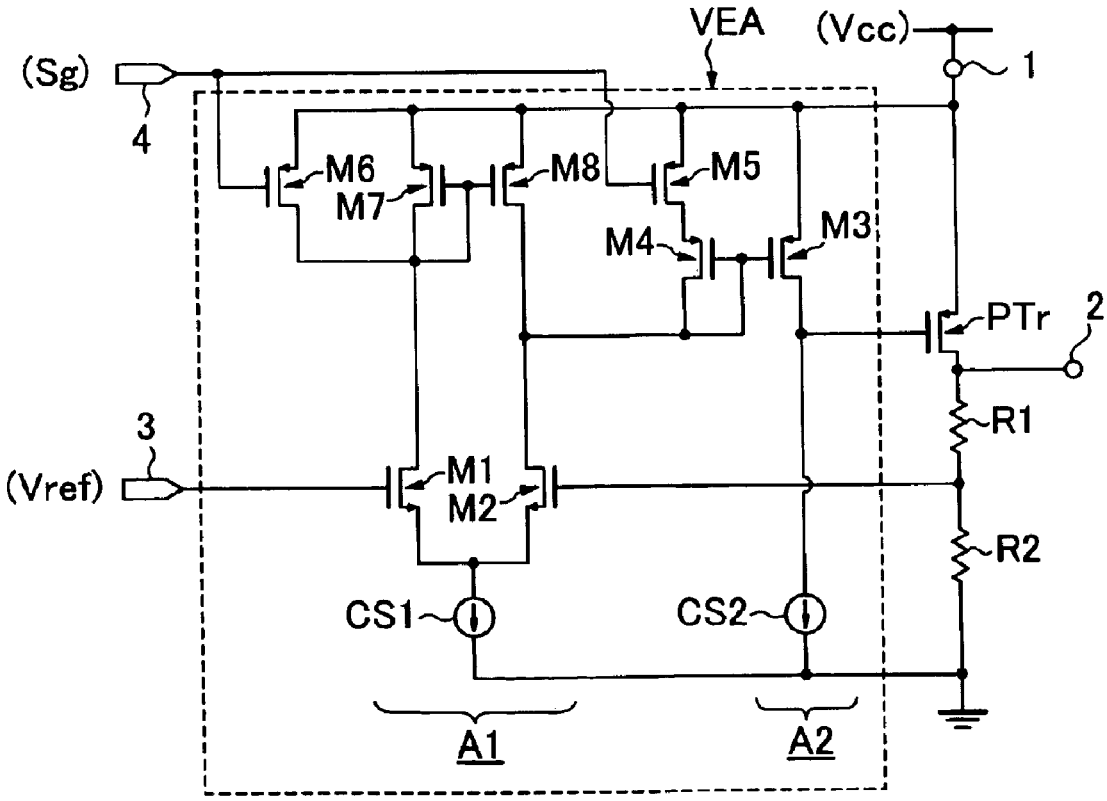
FIG. 3 is a circuit diagram showing one specific example of an error amplifier in FIG. 2.

FIGS. 2 and 3 show a constant voltage power supply capable of eliminating the need for a large circuit area and striking a balance between the high-speed response characteristic in the active mode and the operational stability in the sleep mode, according to one embodiment of the present invention, wherein FIG. 2 shows the relationship of the constant voltage power supply, a load, and a switching logic circuit, and FIG. 3 shows the circuit configuration of an error amplifier serving as a key element of the present invention.

An error amplifier VEA illustrated in FIG. 2 is a variable gain type error amplifier configured as shown in FIG. 3, wherein a signal Sg is supplied thereto through an external control signal input terminal 4 of the constant voltage power supply.

The error amplifier VEA has an output terminal connected to the gate of a series control power transistor PTr, and an inverting input terminal (−) connected to a reference voltage input terminal 3 of the constant voltage power supply for receiving a reference voltage signal (Vref).

The P-channel type power transistor PTr has a source connected to a power supply line (Vcc) with low voltage stability through an input terminal 1 of the constant voltage power supply, and a drain connected to a load 5 through an output terminal 2 of the constant voltage power supply. A resistor R1 and a resistor R2 are connected in series between the drain of the power transistor PTr and the ground, and a node between the resister R1 and the resister R2 is connected to a non-inverting input terminal (+) of the error amplifier VEA. The signal Sg is supplied from a switching logic circuit 6 to the external control signal input terminal 4 in a form representing the state of the load 5.

Specifically, the constant voltage power supply in FIG. 2 is configured such that in response to the signal Sg supplied from the switching logic circuit 6, the gain of the error amplifier VEA is increased when the load is in the active mode, and reduced when the load is in the sleep mode. In this manner, the constant voltage power supply in FIG. 2 can strike a balance between the high-speed response characteristic in the active mode and the operational stability in the sleep mode.

A variable gain type error amplifier operable to change gain in a stepwise manner includes various types, such as (a) one type having a plurality of differential amplifier circuits, and (b) another type having a plurality of intermediate-stage or output-stage amplifier circuit. If a constant voltage power supply incorporates such an error amplifier as the error amplifier VEA in FIG. 2, it is required to assure a large circuit area on an integrate circuit as in the conventional constant voltage power supply having a plurality of error amplifiers.

In order to reduce a circuit area required for being formed on an integrated circuit, the error amplifier VEA to be included in the constant voltage circuit of the present invention is configured as shown in FIG. 3.

Specifically, the respective sources of two N-channel type transistors M1, M2 are connected to a common node to form a differential pair, and the common node between these sources is connected to the ground through a current source CS1. The drain of the transistor M1 is connected to the input terminal 1 of the constant voltage power supply through the main current path of two P-channel type transistors M6, M7 connected in parallel with one another. The drain of the transistor M2 is connected to the input terminal 1 of the constant voltage power supply through the main current path of a P-channel type transistor M8. The respective gates of the transistor M7 and the transistor M8 are connected to a common node, and the gate and source of the transistor M7 are short-circuited to one another.

The drain of the transistor M2 is connected to the gate of a P-channel type transistor M3. The source of the transistor M3 is connected to the input terminal 1, and the drain of the transistor M3 is connected to the ground through a current source CS2. The gate of the transistor M3 is connected to the gate and drain of a P-channel type transistor M4 at respective common nodes, and the source of the transistor M4 is connected to the input terminal 1 through the main current path of a P-channel transistor M5.

The transistors M1, M2, M7, M8 and the current source CS1 act as a differential amplifier circuit A1. The gate of the transistor M1 is connected to the reference voltage input terminal 3 so as to serve as the inverting input terminal (−) of the error amplifier VEA, and the gate of the transistor M2 is connected to the node between the resisters R1 and R2 so as to serve as the non-inverting input terminal (+) of the error amplifier VEA.

The transistor M3 and the current source CS2 act as an output-stage amplifier circuit A2, and the drain of the transistor M3 is connected to the gate of the power transistor PTr to serve as the output terminal of the error amplifier VEA.

The transistors M4, M5, M6 act as a part of a circuit for changing the gain of the error amplifier VEA, and each of the gates of the transistors M5, M6 is connected to the external control signal input terminal 4.

The input terminal 1, the output terminal 2, the power transistor PTr, the resisters R1, R2 provided outside the error amplifier VEA are connected with each other in the same relationship as that in the conventional constant voltage power supply.

The error amplifier VEA configured as above is operable to change its gain in response to the signal Sg to be supplied from the switching logic circuit 6 through the external control signal input terminal 4, as described in detail below. The following description will be made on the assumption that the signal Sg is in High level when the load 5 is in the active mode, and the signal Sg is in Low level when the load 5 is in the sleep mode.

Figure 4:
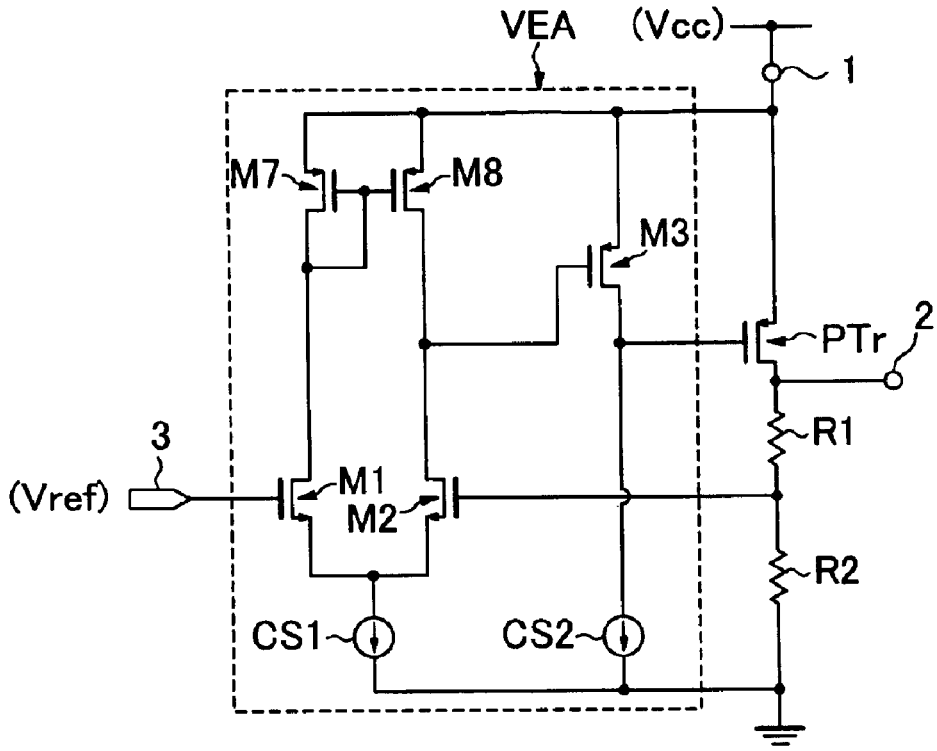
FIG. 4 is an equivalent circuit of the circuit in FIG. 3 in the state when a signal (Sg) is in High level.

When the signal Sg is turned into High level, the transistors M5, M6 are switched into OFF state. In conjunction with the transistor M5, the transistor M4 is also switched into OFF state. Thus, the circuit in FIG. 3 is changed to a circuit configuration as equivalently shown in FIG. 4. The equivalent circuit in FIG. 4 is prepared by eliminating the transistors M4, M5, M6 from the circuit in FIG. 3, and open-circuiting these sections. The error amplifier in the equivalent circuit has the same configuration as that of a conventional error amplifier. Thus, when the circuit in FIG. 3 is changed to the circuit configuration as equivalently shown in FIG. 4, the difference between the signals entered, respectively, into the gates of the transistors M1, M2, or an error signal, is amplified sequentially by the transistor M2, the transistor M3 and the power transistor PTr.

Then when the signal Sg is turned into Low level, the transistors M5, M6 are switched into ON state. The transistor M6 acts to short-circuit between the source and gate of the transistor M7, and thus the transistor M7 is switched into OFF state. Simultaneously, the transistor M8 being in current mirror operation with the transistor M7 is also switched into OFF state. As with the transistor M5, the transistor M4 is switched into ON state, and the transistors M4, M3 perform a current mirror operation based on to the circuit arrangement therebetween. In this state, the circuit in FIG. 3 is changed to a circuit configuration as equivalently shown in FIG. 5. The equivalent circuit in FIG. 5 is prepared by eliminating the transistors M5, M6, M7, M8 from the circuit in FIG. 3, open-circuiting these sections, and then connecting the drain of the transistor M1 and the source of the transistor M4 directly to the input terminal 1.

Figure 5:
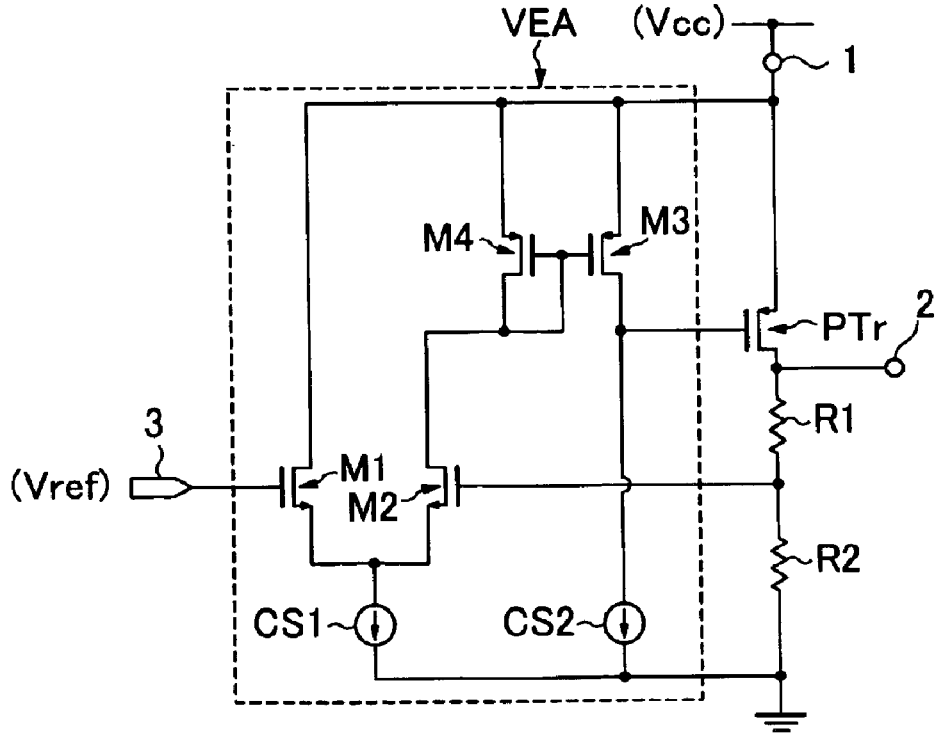
FIG. 5 is an equivalent circuit of the circuit in FIG. 3 in the state when the signal (Sg) is in Low level.

In the equivalent circuit in FIG. 5, given that the transistors M3 and M4 have the same parameter (the ratio between the channel width and the channel length of the transistor), the current flowing through the main current path of the transistor M3 is equal to the current flowing through the main current path of the transistor M4. The current flowing through the main current path of the transistor M4 is the drain current of the transistor M2. In this case, any signal amplification function as in the equivalent circuit in FIG. 4 is vanished away from the transistor M3.

Thus, when the circuit in FIG. 3 is changed to the circuit configuration as equivalently shown in FIG. 5, the difference between the signals entered, respectively, into the gates of the transistors M1, M2, or an error signal, is amplified sequentially by the transistor M2 and the power transistor PTr.

That is, the constant voltage power supply in FIGS. 2 and 3 is operable to change the number of amplification stages in the circuit section between the differential pair of the transistors M1, M2 and the power transistor PTr, from three stages to two stages. More specifically, the transistor M4 is switched into its activated state (or deactivated state) to preclude the signal amplification function of the transistor M3 (or enable the signal amplification function) so as to change a substantial or effective number of amplification stages (the number of amplification stages in the above description "from three stages to two stages" is derived by counting the power transistor as one of the stages).

As compared to the conventional error amplifier circuit (FIG. 4), the error. amplifier VEA in FIG. 3 is configured by adding only the transistors M4, M5, M6 thereto. Thus, the constant voltage power supply of the present invention can strike a balance between the high-speed response characteristic in the active mode and the operational stability in the sleep mode while minimizing the number of additional elements for changing the gain so as to reduce a circuit area required for being formed on an integrated circuit.

Figure 6:
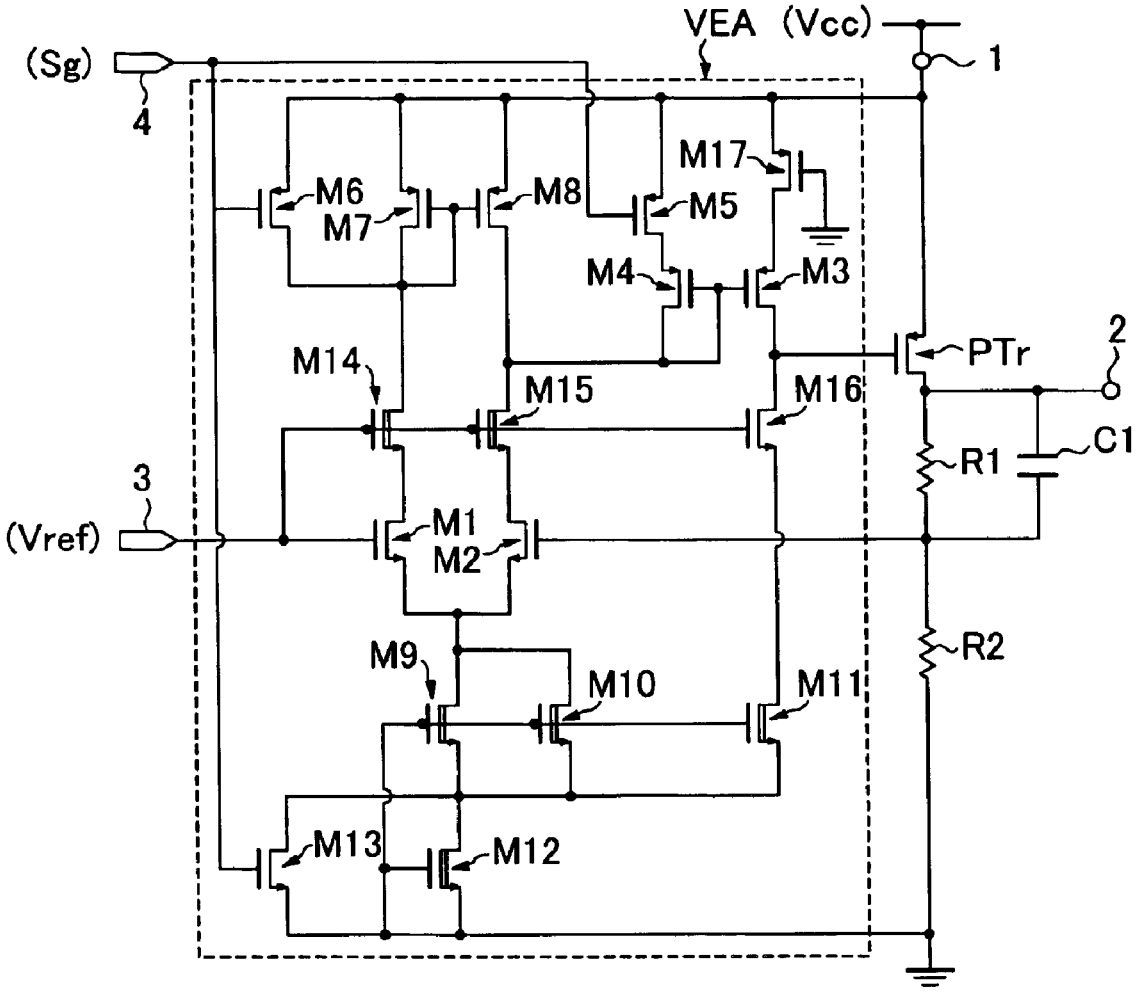
FIG. 6 is a circuit diagram showing another specific example of an error amplifier in FIG. 2.

FIG. 6 is a circuit diagram showing another specific example of an error amplifier in FIG. 2. Except for the following circuit configuration, the circuit in FIG. 6 is substantially the same as the circuit in FIG. 3. In FIG. 6, the same elements as those in FIG. 3 are defined by the same reference numerals or marks, and their detail description will be omitter.

In the circuit of an error amplifier of this example, the current source CS1 in FIG. 3 is substituted with two transistors M9, M10, and each of the drains of the transistors M9, M10 is connected to a common node between the sources of two transistors M1, M2. The current source CS2 in FIG. 3 is substituted with a transistor M11, and the drain of the transistor M11 is connected to the drain of a transistor M3 through the main current path of a transistor M16.

The gates of three depression N-channel type transistors M9, M10, M11 are connected to a common node, and then connected to the ground. A common node between the sources of the transistors M9, M10, M11 is connected to the ground through the main current path of a depression N-channel type transistor M12 having a gate connected to the ground. An enhancement N-channel type transistor M13 is arranged in parallel with the transistor M12, and the gate of the transistor M13 is connected to an external signal input terminal 4.

The main current path of a depression N-channel type transistor M14 is connected between the respective drains of the transistor M1 and a transistor M7, and the main current path of a depression N-channel type transistor M15 is connected between the respective drains of the transistor M2 and a transistor M8. Each of the gates of the transistors M14, M15, M16 is connected to a reference voltage input terminal 3. The main current path of an enhancement P-channel transistor M17 having a gate connected to ground is connected between the source of the transistor M3 and an input terminal 1.

As to the circuit outside the error amplifier VEA, a phase compensation capacitance C1 is connected in parallel with a resistor R1.

In the respect that the gain of the error amplifier is changed in response to a signal Sg, the operation of the above circuit in FIG. 6 is completely the same as that of the circuit in FIG. 3. In addition, the transistors M12, M13 are operable to change the currents flowing through the transistors M9, M10, M11 in connection with the change in the number of amplification stages. More specifically, the operating current of the error amplifier VEA, or the respective operating currents of a differential amplifier circuit including the transistors M1, M2, and an output-stage amplification circuit including the transistor M3, is changed depending on whether a load 5 is in the active mode or in the sleep mode.

For example, if the load is turned into the active mode, and thus the signal Sg to be supplied to the external control signal input terminal 4 is changed into High level, the number of stages for amplifying an error signal will be three as with the circuit in FIG. 3. In this state, the transistor M13 is switched into ON state in response to the signal Sg being in High level. Thus, the voltage between the source and gate of each of the transistors M9, M10, M11 serving as a current source becomes almost zero, and a current equal to the drain cutoff current ($I_{DSS}$), which is specific to each transistor, flows through each main current path of the transistors M9, M10, M11

Then, when the load is turned into the sleep mode, and thus the signal Sg to be supplied to the external control signal input terminal 4 is changed into Low level, the number of stages for amplifying an error signal will be two as with the circuit in FIG. 3. In this state, the transistor M13 is switched into OFF state in response to the signal Sg being in Low level. Thus, a current equal to the drain cutoff current ($I_{DSS}$), which is specific to the transistor M12, flows through the main current path of the transistors M12. The transistor M12 acts to place a limit on the total rate of current flowing through the transistors M9, M10, M11, so that the amount of the operating currents becomes less that that in the state when the transistor M13 is in ON state.

As above, the error amplifier VEA in FIG. 6 is operable to allow a large amount of operating current to flow when the gain thereof is high and to reduce the flow rate of the operating current when the gain is low. Thus, the error amplifier VEA can provide lowered power consumption when the load is in the sleep mode to achieve desirable power saving in the constant voltage power supply.

Each of the three transistors M14, M15, M16 having a gate connected to the reference voltage input terminal 3 serves as a switch for preventing improper operations possibly caused when the reference voltage is not supplied. The transistor M17 acts as a cascode amplifier circuit in corporation with the transistor M3.

The above description of the embodiment has been made on the assumption that the transistors M3 and M4 have the same parameter (the ratio between the channel width and the channel length of the transistor). However, the respective parameters of the transistors M3 and M4 are not necessarily equal to one another. The ratio between the parameters of the two transistors may be set at any suitable value far lower than an amplification factor appearing at the transistor M3 in the equivalent circuit in FIG. 4. Further, while the amplifier circuit section including the transistor M3 has been configured as an output-stage amplifier circuit of the error amplifier VEA in the above embodiment, it may be configured as a part of an intermediate-stage amplifier circuit, and another output-stage amplifier circuit and/or another intermediate-stage amplifier circuit may be additionally provided. Various other modifications, such as integration of a reference voltage generation circuit into the constant voltage power supply or change in the type of transistors, can be made without departing from the spirit and scope of the present invention.

What is claimed is:

1. A constant voltage power supply including a series control transistor connected between of input and output terminals of said constant voltage power supply, and an error amplifier circuit having an output terminal connected to a control terminal of said series control transistor, wherein the operation of said series control transistor is controlled in accordance with an output voltage signal supplied to one input terminal of said error amplifier circuit from said series control transistor, and a reference voltage signal supplied to another input terminal of said error amplifier circuit, so as to provide an stabilized output voltage, said constant voltage power supply comprising:

a first amplifier circuit including first and second transistors, wherein one ends of the respective main current paths of said first and second transistors are connected to a common node to allow said first and second transistors to be formed as a differential pair;

a second amplifier circuit including a third transistor which has an control terminal adapted to be supplied with a signal appearing at the other end of the main current path of said second transistor;

a fourth transistor having an control terminal and an main current path, wherein said control terminal and one end of said main current path are connected to said control terminal of said third transistor to provide a current mirror circuit in conjunction with said third transistor; and a first switch connected in series to the other end of the main current path of said fourth transistor and adapted to be switched in response to an external control signal.

2. The constant voltage power supply as defined in claim 1, wherein said third transistor has the ratio between the channel width and the channel length thereof, equal to that of said fourth transistor.

3. The constant voltage power supply as defined in claim 2, which further includes:

first and second active load elements connected to the other ends of the main current paths of said first and second transistors, respectively; and a second switch adapted to be switched in response to said external control signal, wherein when said second switch is in its on-state, it is operable to short-circuit between both terminals of said first active element and cut off said second active load element.

4. The constant voltage power supply as defined in claim 3, wherein said external control signal represents either one of a first state when a load is in a sleep mode, and a second state when a load is in an active mode, wherein said first and second switches are adapted to be switched into their ON state in response to said external control signal representing said first state, and to be switched into their OFF state in response to said external control signal representing said second state.

5. The constant voltage power supply as defined in claim 1, which further includes:

first and second active load elements connected to the other ends of the main current paths of said first and second transistors, respectively; and a second switch adapted to be switched in response to said external control signal, wherein when said second switch is in its on-state, it is operable to short-circuit between both terminals of said first active element and cut off said second active load element.

* * * * *